US005413506A

United States Patent [19]

Thompson

[11] Patent Number: 5,413,506

[45] Date of Patent: May 9, 1995

[54] ELECTRICAL CONNECTOR ASSEMBLY

[75] Inventor: Ray Thompson, Dudley, Great Britain

[73] Assignee: Cliff Electronic Components Limited, Great Britain

[21] Appl. No.: 54,045

[22] Filed: Apr. 27, 1993

[30] Foreign Application Priority Data

Jul. 8, 1992 [GB] United Kingdom ..... 9214531

[51] Int. Cl.[6] ..... H01R 17/00

[52] U.S. Cl. ..... 439/660; 439/692; 439/695

[58] Field of Search ..... 439/660, 668, 669, 675, 439/578–585, 677, 692, 736, 695

[56] References Cited

U.S. PATENT DOCUMENTS

| | | | |
|---|---|---|---|
| 1,435,819 | 11/1922 | Des Isles | 439/675 |
| 2,520,739 | 8/1950 | Shaw | 439/668 |
| 2,576,174 | 11/1951 | Denine | 439/668 |
| 2,749,526 | 6/1956 | Petersen | 439/668 |
| 3,024,295 | 3/1962 | Moore | 439/668 |

FOREIGN PATENT DOCUMENTS

| | | | |
|---|---|---|---|
| 2645450 | 4/1978 | Germany | 439/668 |

*Primary Examiner*—David Pirlot

[57] ABSTRACT

An electrical connector assembly has a plug (1) and socket (2) which are engageable along axis (3) for a plug body (34) to be received within a socket body (4) as a tubular core (5) of the socket receives a core (35) of the plug. Spring terminals (13) are located within an annular cavity (7) and blade terminals (31) are located within an annular cavity (36) of the respective socket and plug bodies. Terminals (13) have cantilevered contact faces (18) inclined relative to the axis (3) and the terminals (31) have contact edges (52) which slide over the contact faces (18) to provide electrical contact and a cleaning/wiping action therebetween. Contact faces (18) are displaced inwardly against their resilient biasing by engagement with the contact edges (52) while the terminals (31) are restrained from outward displacement by seatings (42) in the wall (34).

The spring terminals (13) and blade terminals (31) are fitted axially to their respective bodies through slots 11 and (38) respectively. The terminals (13) and (31) terminate axially short of leading ends (8) and (37) and the annular cavities (7) and (36) may ensure that the terminals are inaccessible to a standard test finger. A bayonet lock ring (32) may be provided between the plug and socket.

28 Claims, 5 Drawing Sheets

ELECTRICAL CONNECTOR ASSEMBLY

TECHNICAL FIELD & BACKGROUND ART

The present invention relates to an electrical connector assembly comprising two members which are engageable and dis-engageable with each other in a direction axially of those members in making or breaking electrical contact between terminals in the members. Typically one member will be in the form of a plug and the other in the form of a socket.

It is well known to provide the two members for an electrical connector of the kind discussed above in the form of axially extending tubular bodies which engage one within the other and within which the terminals are located; it is an object of the present invention to provide such a connector in which electrical contact between the terminals of the two members provides an efficient wiping and self cleaning action as the two members are moved into and out of engagement and which assembly lends itself to relatively inexpensive and simple manufacture of components having dimensional and structural characteristics which meet the requirements of British Standard 3042:1971 and International Standard IEC 335-1 (which concern checking the inaccessibility of live parts in each member with a standard test finger so that live parts in the two members may be regarded as "touchproof").

STATEMENT OF INVENTION & ADVANTAGES

According to the present invention there is provided an electrical connector assembly comprising two members which are engageable and dis-engageable co-axially with each other in a direction axially of those members for making and breaking respectively contact between terminals in the members; a first said member comprising an axially extending tubular body having axially opposed first and second ends which respectively lead and trail during said engagement and the second member comprising an axially extending tubular body having axially opposed first and second ends which respectively lead and trail during said engagement; the first member having axially extending substantially straight and flat blade terminals within its tubular body and spaced circumferentially about its axis; the blade terminals extending from the second end of the first member body and terminating short of the first end thereof and each blade terminal lying, substantially, in a plane which includes the axis of the first member to present a radially directed axially extending contact edge and a radially directed axially extending support edge, the support edges of the blade terminals engaging substantially over their axial length with the body of the first member; the second member having spring terminals which extend axially within its tubular body from the second end of that body and terminate short of the first end thereof; said spring terminals being spaced circumferentially about the socket axis to correspond with the blade terminals when the two members are engaged; each spring terminal lying substantially in a plane which includes the axis of the second member and comprising a base part mounted on the body of the second member and a leaf terminal part which is cantilevered from the base part and presents a contact face directed radially relative to the axis of the second member, said contact face being inclined relative to the axis of the second member to converge towards the base part of its spring terminal as it approaches the end at which it is cantilevered and the first end of the second member; and wherein during engagement of the two members the tubular body of one member is received axially within the tubular body of the other member initially without contact between the blade terminals and the spring terminals and subsequently the radially directed contact edges of the blade terminals engage and slide over the radially directed contact faces of the respective leaf terminal parts causing said leaf terminal parts to be displaced radially relative to the axis of the second member and against their resilient biasing for substantial axial lengths of the contact edges of the blade terminals to abut in edge-to-face relationship the contact faces of the leaf terminal parts while the blade terminals are restrained from radial displacement relative to the axis of the second member by engagement of their support edges axially along the body of the first member.

By the assembly of the present invention it is intended that as a contact edge of a blade terminal abuts and makes electrical contact with a contact face of a spring terminal during axial engagement of the two members (which may conveniently be regarded as a plug and socket), the biasing afforded by the natural resilience of the spring terminals urges their contact faces into abutment with the contact edges and maintains contact pressure as the two members are moved into their full engagement. Furthermore, the aforementioned contact pressure is maintained as the two members are disengaged axially substantially until the blade terminals move out of contact with the spring terminals The electrical contact will usually be effected by substantially straight contact edges of the blade terminals abutting, preferably over their major axial length, respective contact faces of the spring terminals—usually the abutment will be substantially parallel with the axes of the two members. Usually the tubular bodies of the two members will be cylindrical which is convenient for ensuring that when the two members are in engagement with each other they are substantially co-axial. The radial displacement of the resilient leaf terminal parts during their engagement and dis-engagement with the blade terminals provides a wiping and self cleaning action to the contact surfaces and with these characteristics of consistent contact pressure and self cleaning action between the terminals it is possible to provide relatively small structures for the two members suitable for carrying relatively high currents, for example up to 30 amps as may be typical for connecting high wattage speakers with an amplifier system. Also with the two members being of a relatively compact size and the terminals in those members terminating axially short of the first ends of the bodies of the two members, the structure of the assembly lends itself towards satisfying the inaccessibility test to the live parts by a standard finger as specified in B.S. 3042:1971 and International Standard IEC 335-1. The inaccessibility of the terminals within the tubular bodies of the two members from the first ends of the member bodies when separated (so that the terminals may be regarded as "touchproof") may be enhanced by locating the terminals within annular cavities formed by the two tubular bodies so that each body effectively includes a co-axial core, one core being tubular so that it receives the other core when the two bodies are engaged axially. The annular cavities will open at the first end of each tubular body and preferably will have a radial width which ensures that the terminals within the annular cavity are touchproof in that they are inaccessible through the first end of the respective annular cavity by a standard test finger. Where the tubular bodies are provided with cores as aforementioned, it is preferred that the base parts of the spring terminals are mounted on the core of the second member so that their contact faces are directed radially outwardly of the axis of the second member and the contact faces are inclined relative to the axis of the second member to converge towards that axis as they approach the ends at which they are cantilevered and the first end of the second member while the blade terminals have their support edges engaging in an outer tubular wall part of the first member so that their contact edges are directed radially inwardly in the annular cavity of the first member. In an alternative structure in which the two members are provided with axially extending cores as aforementioned, the blade members may be mounted so that their support edges engage with the core of the first member for their contact edges to be directed radially outwardly of the axis of that member while the base parts of the spring terminals are mounted on an outer tubular wall part of the second member so that the contact faces of the spring terminals are directed radially inwardly in the annular cavity of that member and the contact faces are inclined relative to the axis of the second member to diverge from that axis as the contact faces approach the ends at which the leaf terminal parts are cantilevered and the first end of the second member. Where either the first or second member has its terminals mounted on an outer tubular wall part of that member (and not on a core of the member) then it is not essential for that member to have a core although the provision of a core is preferred, as previously discussed, to form an annular cavity which is convenient for meeting the requirements that the electrical contacts are inaccessible by a standard test finger within the annular cavity. It will be realised that the core and outer tubular wall part of the member may not, necessarily, be of circular section, for example they may be of polygonal section, so the cavity referred to may not be truly "annular" and the term "annular" as used herein is intended to include cavities which may not be of truly circular formation.

Preferably the blade terminals have their support edges located in firm engagement with axially extending slots or channels in the body of the first member. The blade terminals may be received in the aforementioned slots or channels axially as a sliding fit by insertion of those terminals through the second end of the body of the first member during assembly of that member. Desirably retaining means is provided for retaining the blade terminals in engagement with the slots or channels in which they are respectively received; in a preferred arrangement the retaining means comprises recesses and projections which co-operate between the blade terminals and the body of the first member and which recesses and projections snap engage during insertion of the blade terminals into the body of the first member. Preferably the axially extending support and contact edges of a blade terminal are substantially straight and parallel to each other.

Preferably each axially extending spring terminal has its base part doubled with the leaf terminal part with the base part supported over its axial extent by the body of the second member. In a preferred arrangement the base parts of the spring terminals are received in substantially complementary axially extending channels or seats in the body of the second member. The base parts of the spring terminals are preferably received in the aforementioned channels or seats axially as a sliding fit by insertion of the spring terminals through the second end of the body of the second member during assembly of that member. Means, such as a retaining plate adhesively secured or welded to the second end of the body for the second member, may be provided for retaining the spring terminals axially within that member.

The blade terminals are conveniently stamped or otherwise cut to the required profile from flat sheet metal while the spring terminals are conveniently stamped or otherwise cut from spring metal sheet as straight strips which are subsequently bent to the profile required of the base part and cantilevered spring leaf part.

Preferably one of the two members includes a locking ring mounted on the body of that member for rotation about the axis thereof. The locking ring is profiled to provide part of a bayonet lock while the body of the other member is profiled with another part of the bayonet lock which is complementary to that part in the locking ring whereby when the two members are fully engaged axially, the bayonet lock parts of the locking ring and said other member co-operate with each other and the locking ring can be rotated relative to the bodies of the two engaging members to actuate the bayonet lock and prevent the two bodies from being dis-engaged axially. By the provision of such a locking ring (which will preferably rotate in a constant radial plane of the member on which it is carried) it will be appreciated that there is no necessity for relative rotation between the two members during their engagement to lock those members with each other when fully engaged. The locking ring is conveniently a snap engaging fit on the body of the member which carries it. Co-operating projections and recesses may be provided between the locking ring and one of the members (preferably the member which includes the ring) so that as the ring approaches a locked or unlocked condition increased torque has to be applied to the locking ring to overcome resistance presented by the co-operating recesses and projections and effect the final lock or unlock—this is intended to alleviate the possibility of the two members being inadvertently unlocked from their engaged condition, possibly as a result of vibration. Preferably the locking ring is carried by the first member having the blade terminals.

Having in mind the preferred characteristics of the first and second members of the assembly in accordance with the present invention in that the terminals of those members should be inaccessible to a standard test finger applied through the first ends of the respective members, it will be realised that the second ends of those members will usually be inaccessible by enclosure within housing parts of the respective members or by casings or cabinets of electrical apparatus to which one or other of the members may be fitted.

The number of terminals with which each of the first and second members is provided will vary depending upon the intended use of the electrical connector assembly but typically four, eight or twelve terminals will be fitted in each member.

DRAWINGS

One embodiment of an electrical connector assembly constructed in accordance with the present invention and in the form of a plug and socket will now be described, by way of example only, with reference to the accompanying illustrative drawings, in which.

DETAILED DESCRIPTION OF DRAWINGS

Figure 1:
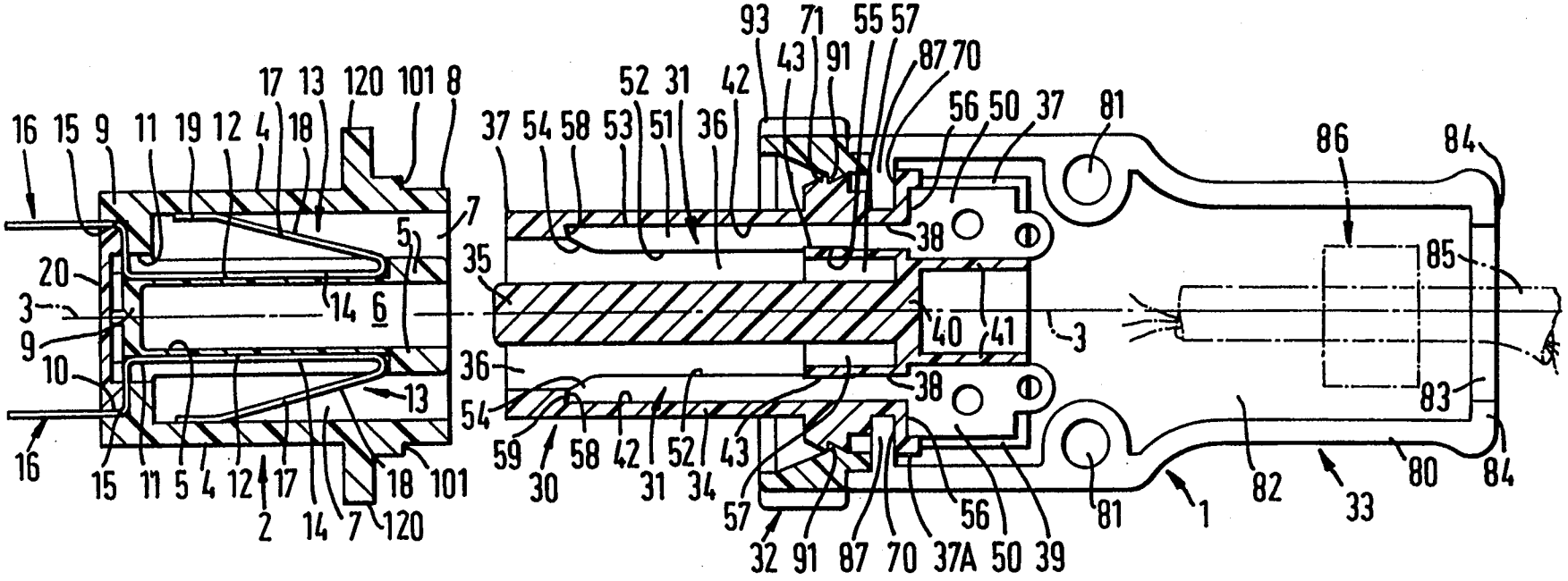
FIG. 1 is an axial section of the plug and socket when dis-engaged.

The electrical connection assembly consists of an axially extending plug 1 and an axially extending socket 2 which are engageable and dis-engageable in co-axial relationship by displacement of the plug and socket along their axes 3 relative to each other.

The socket 2 comprises a one piece plastics moulded body having a tubular cylindrical outer wall 4 and a tubular cylindrical core 5 which has a bore 6 and forms an annular cavity 7 with the outer wall 4. The annular cavity 7 and bore 6 open at a first end 8 of the socket 2 and are concentric with the axis 3. An end wall 9 of the socket body at its second end axially remote from its end 8 closes the bore 6 and is provided with a generally circular and concentric recess 10 which communicates by way of a circumferentially spaced array of slots 11 in the wall 9 with the annular cavity 7 adjacent to the core 5. The slots 11 correspond in number to the number of terminals which are to be provided in the socket 2 and in the present example four such terminals are to be provided. Each of the slots 11 communicates with an axially extending and substantially straight channel or seating 12 provided in the outer cylindrical surface of the core 5.

Figure 3:
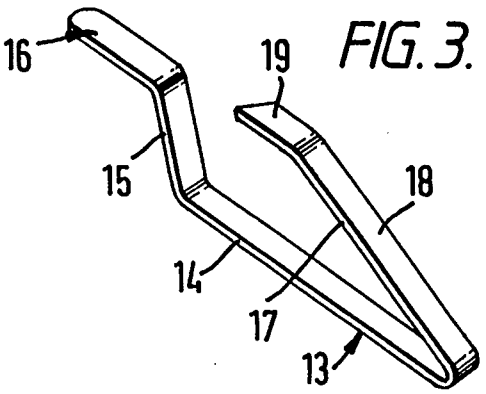
FIG. 3 is a perspective view of a spring terminal for the socket.
Figure 4:
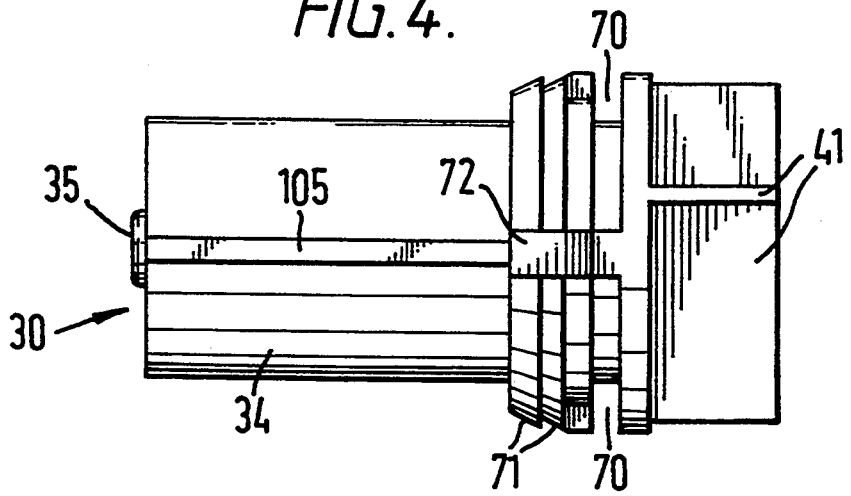
FIG. 4 is a side elevation of a body for the plug.

Fitted to the body of the plug 2 are four spring terminals 13. Each terminal 13 (see FIG. 3) is stamped or otherwise cut initially as a flat strip from a sheet of spring metal. The metal strip is bent to the configuration shown in FIG. 3 so that the terminal 13 has a straight base part 14 one end of which is cranked at 15 to form a terminal connection tail 16. Extending from the other end of the base part 14 is a resilient leaf terminal part 17 which is cantilevered from and doubled with the base part 14 to present an outwardly directed substantially flat contact face 18. The leaf terminal part 17 has its free end 19 dog-legged. Each spring terminal 13 is fitted to the socket body by closing the leaf terminal part 17 against its natural resilient biasing for that part to lie on the base part 14 and inserting the terminal with its doubled end leading axially through a slot 11 in the second end wall 9 of the socket body so that the base part 14 is received as a complementary sliding fit within the channel 12 associated with the respective slot 11. During axial insertion of the terminal 13 and when the dog-leg end 19 clears the slot 11, the terminal springs open as shown in FIG. 1 for its end 19 to abut the cylindrical inner surface of the outer wall 4 to retain the terminal firmly in its seating channel 12. In this latter condition the terminal 13 lies generally in a plane which includes the socket axis 3 so that the contact face 18 is directed radially outwardly relative to the axis 3 and is inclined to converge towards that axis as it approaches the first end 8 of the socket. Also, as is seen from FIG. 1, the fitted terminals 13 terminate short of the first end 8 of the socket body. Following insertion of the four terminals 13 in their respective channels 12, an appropriately profiled plastics retaining plate 20 is fitted in the recess 10 over the cranked parts 15 of the terminals and ultrasonically welded to the socket body to firmly secure the spring terminals 13 in that body.

The plug 1 is formed as an assembly basically comprising a generally tubular body 30 to which is fitted four blade terminals 31; a locking ring 32 mounted for partial axial rotation on the plug body 31, and a housing 33. The plug body 30, ring 32 and housing 33 are formed as plastics mouldings while the blade terminals 31 are stamped from flat metal sheet.

The plug body 30 (see FIGS. 4 to 8) has a tubular cylindrical outer wall 34 which is to be received axially as a close sliding fit within the cylindrical inner face of the socket body wall 4 and a cylindrical co-axial core 35 which is to be received axially as a close sliding fit within the bore 6 of the socket core 5. The wall 34 and core 35 form an annular cavity 36 in the plug body that opens at a first end 37 of that body and is substantially closed by an end wall 40 at the axially opposed second end 37A of that body. Provided in the end wall 40 are four circumferentially spaced radially extending slots 38 which communicate through the end wall 40, one each, between four terminal head compartments 39 and the annular cavity 36. The compartments 39 are formed by axially projecting partition walls 41 extending from the end wall 40 of the plug body. The slots 38 are disposed in a circumferential array corresponding to that of the spring terminals 13 in the socket 2 and each slot 38 communicates with an axially extending straight channel-like slot 42 formed in the inner cylindrical surface of the outer wall 34 of the plug body. Formed within each slot 38 is a small radially outwardly extending land or shoulder 43.

Figure 9:
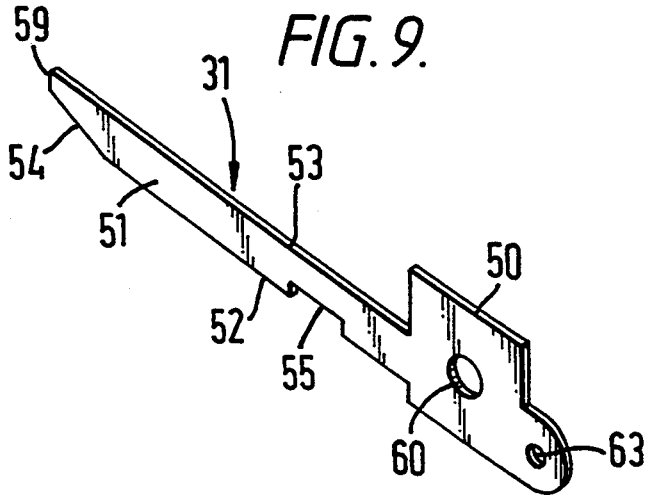
FIG. 9 is a perspective view of a blade terminal for the plug.
Figure 10:
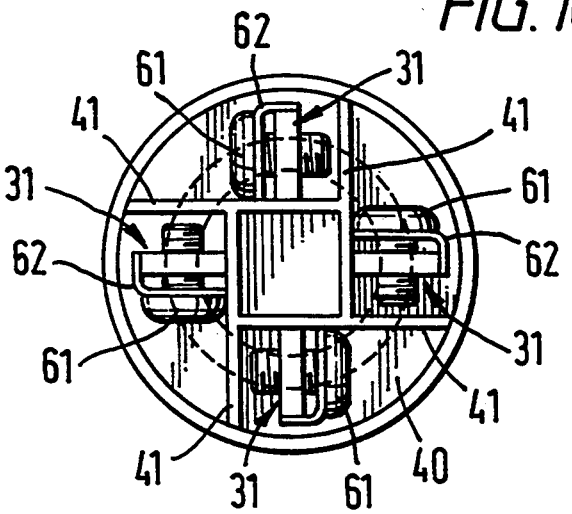
FIG. 10 is an opposite end view of the plug body similar to that shown in FIG. 8 with blade terminals fitted.

Each terminal 31 for the plug (see FIG. 9) has a generally rectangular head 50 from which extends a blade 51 with substantially straight and parallel opposed edges that provide a contact edge 52 and a support edge 53. The end of the contact edge 52 remote from the head 50 is provided with a chamfered lead-in edge part 54. The contact edge 52 is also provided, at its end towards the head 50, with a recess 55 which is substantially complementary in shape to the shoulder or land 53 in the plug body. The four blade terminals 31 are fitted to the plug body 30 in an identical manner whereby the terminal blade 51 is inserted with its chamfered edge part 54 leading through a slot 38 from the second end 37A of the plug body so that its support edge 53 is received axially and as a close sliding press fit within the channel-like slot 42. As the blade terminal 31 is pressed axially further into the plug body 30 its support edge 53 slides along the seating 42 until the shoulder 43 associated with the respective slot 38 snap engages with the recess 55 in the contact edge of the blade. This latter snap engagement serves to retain the blade terminal in the plug body 30 with the rectangular head 50 firmly seated in a complementary profiled recess 56 in the end wall 40. To facilitate the aforementioned snap engagement the plastics material in the plug body radially underlying the shoulders or lands 43 is relieved by an annular rebate 57. The blade 51 is preferably held firmly in its slot 42 by frictional engagement of its marginal part adjacent to the support edge 53 within the slot 42. The end of the slot 42 adjacent the first end 37 of the plug body 30 terminates axially short of that first end and is provided with an undercut 58 with which a leading angled nose 59 of the blade 51 engages in complementary manner during fitting of the blade. The engagement of the nose 59 with the undercut 58 serves to additionally retain the terminal blade firmly in its seating 42, particularly against displacement radially inwardly of the plug body. Each blade 31 when fitted has its contact edge 52 substantially parallel with the axis 3 and directed radially inwardly and each blade lies substantially in a plane which includes the axis 3. The terminal head 50 of each blade is provided with a threaded hole 60 that receives a screw 61 by which a plate 62 on the screw can be adjusted to clamp electrical cable wire to the blade terminal. Alternatively a cable wire may be received through an eye 63 on the terminal head and soldered thereto.

Figure 5:
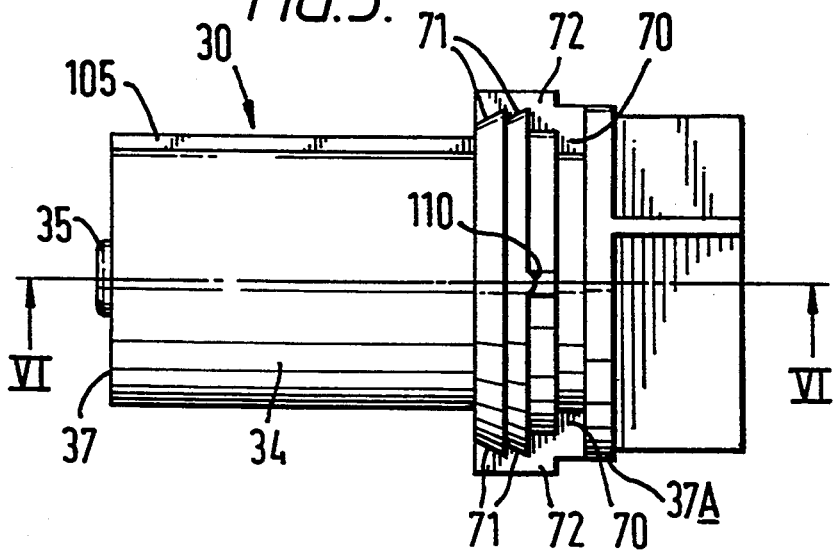
FIG. 5 is a plan view of the plug body shown in FIG. 4.
Figure 6:
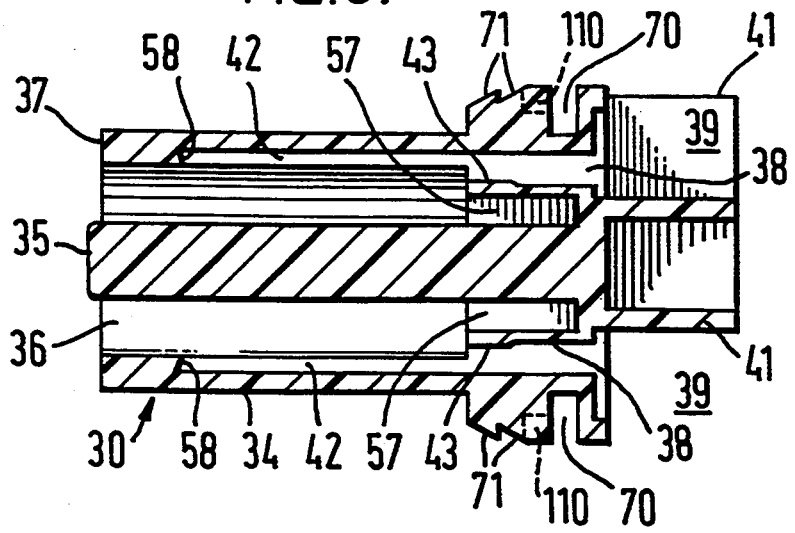
FIG. 6 is a section of the plug body taken on the line VI—VI of FIG. 5.
Figure 7:
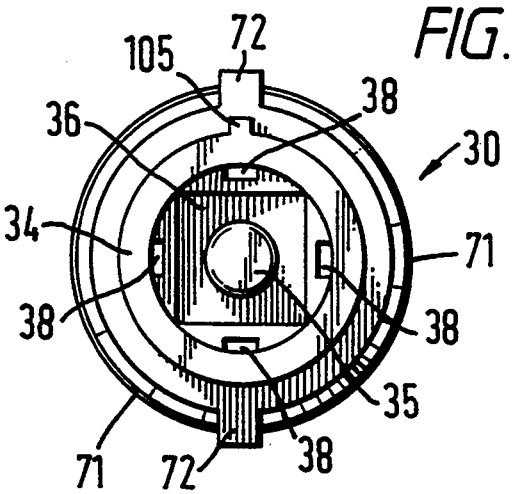
FIG. 7 shows one end view of the plug body.
Figure 8:
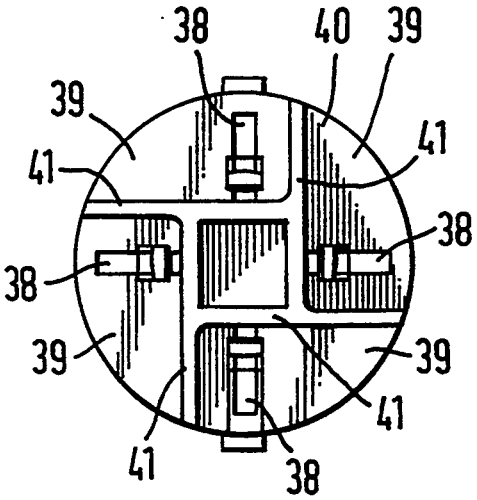
FIG. 8 shows an opposite end view of the plug body.

Formed with the plug body 30 adjacent to its second end 37A is a radially outwardly directed generally annular recess 70. Adjacent to the recess 70 and on the side thereof remote from the second end 37A are a pair of radially outwardly directed, co-axial and generally annular ribs 71, the outer periphery of which present a ratchet or saw-tooth profile in axial section of the plug body (as will be seen from FIGS. 1 and 6). The ribs 71 and recess 70 are interrupted by a pair of diametrically opposed axially extending ribs 72 (FIGS. 5 and 7).

Figure 11:
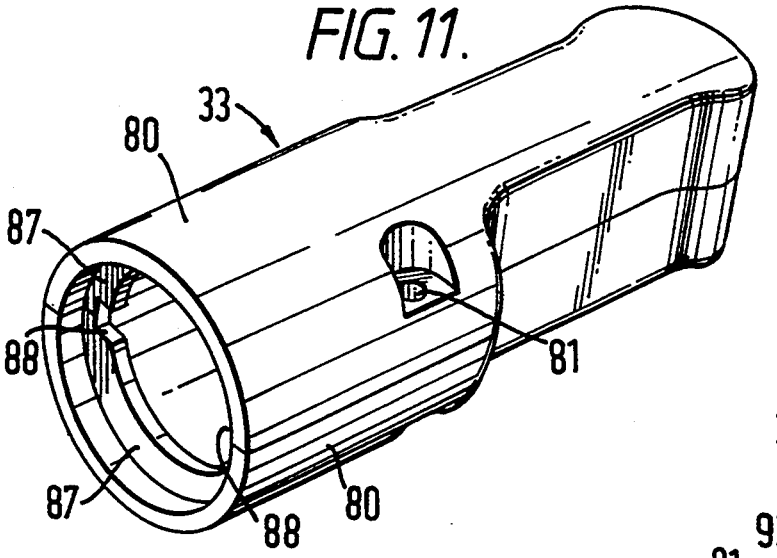
FIG. 11 is a perspective view of a housing for the plug.
Figure 12:
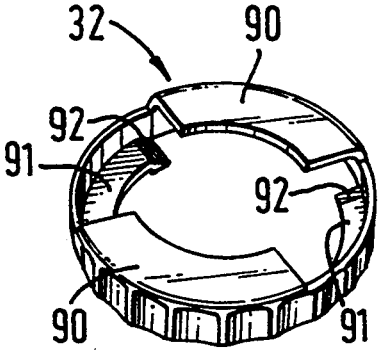
FIG. 12 is a perspective view of a locking ring for fitting to the plug body shown in FIG. 4.
Figure 13:
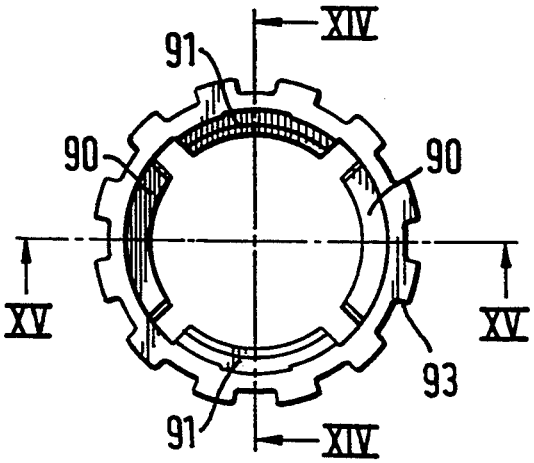
FIG. 13 is a plan view of the locking ring shown in FIG. 12.
Figure 14:
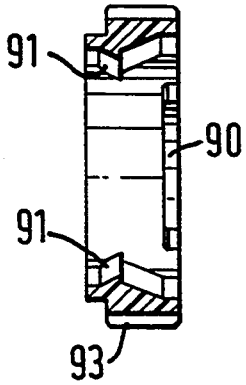
FIGS. 14 and 15 are sections taken on the lines XIV—XIV and XV—XV respectively of the ring shown in FIG. 13.

The housing 33 is formed by a pair of identical plastics moulded shells 80 which are secured together in directly opposing relationship by bolts extending through co-inciding holes 81. The housing 33 provides an axially extending chamber, one end of which is provided with an opening 83 formed between opposing radially extending recessed flanges 84 on the housing shells. A cable 85 for connection to the plug terminals is intended to be introduced to the plug through the opening 83. If required cable retaining means shown generally at 86 can be provided within the housing 33 to clamp cable which the plug receives. The end of the housing 33 remote from its opening 83 is of generally cylindrical profile and each shell 80 is provided with a radially inwardly extending generally semi-annular flange 87 which has its circumferential ends rebated so that when the housing is assembled the flanges 87 directly oppose each other in a diametral plane and form diametrically opposed recesses 88 (FIG. 11). For assembly of the housing 33 with the plug body 30 (with its blade terminals fitted), the shell halves 80 are brought together to enclose the second end 37A of the plug body 30 and capture and firmly secure that end relative to the housing as the housing flanges 87 move into radial engagement as a complementary fit with the generally annular recesses 70 in the plug body. In closing the housing about the plug body the axially extending ribs 72 of the plug body are received as a complementary fit in the diametrically opposed recesses 88 formed between the annular flanges 87 of the housing thereby restraining the plug body from rotating relative to the housing when the shells of the latter are bolted together. This latter structure also ensures a desired orientation is provided between the plug body and the housing. In use of the plug the cable 85 will usually be attached to the terminal heads 50 prior to closing the housing shells together and firmly securing the plug body relative to the housing.

Figure 15:
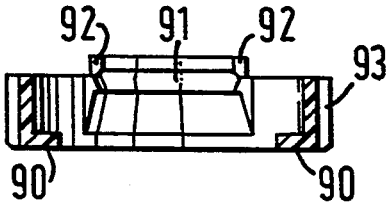

The locking ring 32 (FIGS. 12 to 15 is of generally annular form and is provided at one axial end thereof with a pair of radially inwardly extending and diametrically opposed part annular flanges 90 and at the other axial end thereof with a pair of radially inwardly directed and diametrically opposed saw or ratchet toothed flanges 91. The diametrical alignment of the flanges 90 is at right angles to the diametrical alignment of the toothed flanges 91. The circumferentially spaced ends of the toothed flanges 91 are provided with small radially inwardly extending projections 92 (FIG. 15). The outer generally cylindrical surface of the locking ring is provided with a castellated profile 93 convenient for handling. The locking ring 32 is fitted to the plug body 30 by inserting the first end 37 of the plug body axially through the locking ring with the toothed flanges 91 of that ring presented axially towards the ratchet toothed flanges 71 on the plug body. The plug body is passed through the locking ring until the toothed flanges 91 move over a leading one of the ratchet surfaces on the flanges 71 and snap engage as a complementary fit within the generally annular V-sectioned groove formed between the saw toothed profiles presented by the flanges 71. This latter snap engagement firmly retains the locking ring 32 axially on the plug body 30 irrespective of whether or not the housing 33 is fitted thereto. Furthermore the snap engaging fit of the locking ring 32 on the plug body permits that ring to rotate about the axis 3 in a diametral plane relative to the plug body. During its fitting the locking ring is rotationally orientated so that the axially extending ribs 72 of the plug body are received in the diametrically opposed annular spaces formed between adjacent ends of the two toothed flanges 91 so that rotation of the locking ring relative to the plug body is restricted by abutment between the circumferential ends of the flanges 91 and the ribs 72.

The locking ring 32 is intended to engage as a bayonet fit with the socket body 4 and for this purpose the wall 4 of the socket body is provided at its first end 8 with a pair of diametrically opposed, part annular and outwardly extending flanges 100 (FIG. 2) which form between circumferentially adjacent edges thereof a pair of diametrically opposed part annular recesses 101 (FIG. 1). The flanges 100 correspond, with clearance, to the diametrically opposed part annular openings formed between the circumferentially adjacent ends of the opposed flanges 90 of the locking ring.

Figure 2:
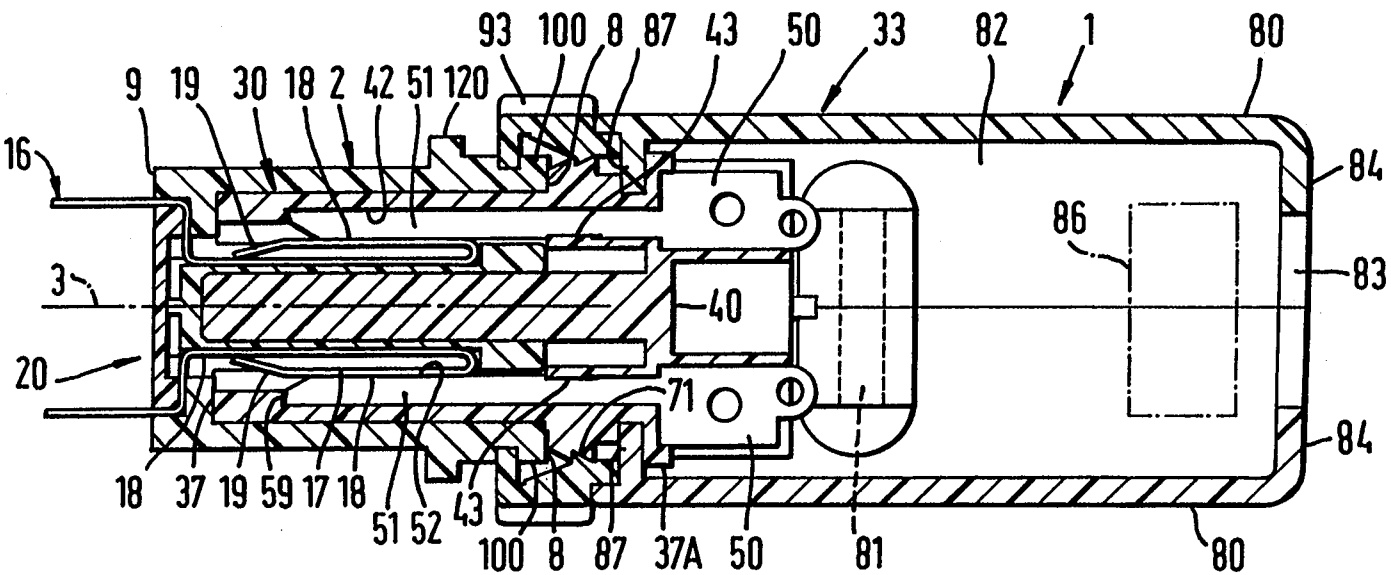
FIG. 2 is a similar section to that in FIG. 1 and shows the plug and socket in engagement.

In fitting the plug 1 to the socket 2 during use of the connector assembly, the plug and socket are displaced axially towards each other with their first ends 37 and 8 leading and with the plug rotationally orientated relative to the socket so that the blade terminals 31 are axially-in alignment with the spring terminals 13 with which they are respectively to engage. For the purpose of ensuring correct rotational orientation between the plug and socket during their engagement, the cylindrical outer surface of the plug body wall 34 is provided with an axially extending key rib 105 (FIGS. 4, 5 and 7) which has to be received axially as a sliding fit within a complementary axially extending keyway or channel (not shown) provided in the cylindrical inner face of the socket body wall 4. The cylindrical wall 34 of the plug body is received as a close sliding fit within the bore of the socket wall 4 as the plug core 35 is received as a close sliding fit within the bore 6 of the socket core 5. As the spring terminals 13 terminate short of the first end 7 of the plug body and the blade terminals 31 terminate short of the first end 37 of the plug, it will be appreciated that during initial insertion of the plug into the socket no contact is made between the spring and blade terminals. As the plug is progressively pressed into the socket, the lead-in edges 54 of the blade terminals abut and effect electrical contact with the contact faces 18 of the respective spring terminals and these contact faces are displaced radially inwardly of the socket as the contact edges 52 of the blade terminals ride over the contact faces 18 until the plug is fully engaged axially within the socket as shown in FIG. 2. In this latter condition it will be seen that the contact edges 52 abut the contact faces 18 in edge-to-face relationship over a considerable axial length of the contact surfaces. Furthermore, the natural resilience of the spring terminals 13 biases the contact faces 18 under constant pressure into abutment with the contact edges 52. It will also be seen from FIG. 2 that as the spring leaf terminal parts are displaced radially inwardly by the overriding blade terminals, the dog-leg end parts 19 of the spring terminals abut their respective base parts 18 for the dog-leg profile and natural resilience of the material to provide additional spring biasing to urge the contact faces 18 into abutment with the contact edges 52. In this way, efficient electrical contact is achieved between the spring terminals and blade terminals following from the initial contact between those terminals due to the biasing pressure exerted by the leaf terminal parts 17 both during the making of the electrical contact and the breaking of that contact as the plug and socket are engaged and dis-engaged. Furthermore, an effective cleaning and wiping action is provided between the contact edges 54 and 52 and the contact faces 18 as the two surfaces slide axially over each other.

When the spring contacts 13 and blade contacts 31 are fully engaged it will be apparent from FIG. 2 that the blades 51 are firmly supported against deflection radially outwardly of the axis 3 by their seating in the channels 42 to withstand considerable contact pressure applied by the spring terminals 13.

During axial engagement between the plug 1 and socket 2 the locking ring 32 is positioned so that its flanges 90 are received within the recesses 101 to permit full axial engagement. In this latter condition the locking ring is rotated relative to the socket and spigot bodies to effect a bayonet engagement where its flanges 90 overlie axially the flanges 100 of the socket body so that the plug and socket are locked in engagement. From FIGS. 5 and 6 it will be seen that the saw toothed profiled annular flange 71 adjacent to the recess 70 in the plug body is provided with a pair of diametrically opposed axially extending stud-like projections 110 which are disposed circumferentially between the pair of ribs 72. During rotation of the locking ring on the plug body and as that ring approaches either its fully locked or unlocked condition it is necessary to apply increased torque to the ring to displace the small projections 92 on its toothed flanges 91 circumferentially over the studs 110 so that the locking ring will effectively click into either its fully locked or unlocked condition. This latter action and the co-operation between the projections 92 and studs 110 has the effect of retaining the locking ring in either its locked or unlocked condition to alleviate inadvertent rotation of the locking ring as, for example, may otherwise result from vibration.

For use of the plug and socket assembly the socket body 4 will usually include a radially outwardly extending flange plate 120 through which the socket may be secured by bolts or otherwise to an electrical cabinet within which the spring terminal tails 16 are presented for electrical connection remote from finger contact. The heads 50 of the blade terminals 31 are enclosed within the housing 33 to be secure from finger contact. Having in mind that the plug and socket may be utilised for providing high wattage electrical connection (which may be, say, 30 amps at 110 volts), it is preferred that the spring terminals 13 and blade terminals 31 are inaccessible to contact through the first end 8 of the socket and the first end 37A of the plug by a standard test finger which meets the requirements of British Standard 3042:1971 and International Standard IEC 335-1 and the radial width of the annular cavities 7 and 36 are determined to meet these safety requirements so that the terminals are effectively "touchproof" in use of the plug and socket both when those components are engaged and dis-engaged from each other.

I claim:

1. An electrical connector assembly comprising first and second members which are engageable and dis-engageable co-axially with each other in a direction axially of those members for making and breaking respectively contact between terminals in the members; each of said first and said second members having an axially extending tubular body with axially opposed first and second ends which respectively lead and trail during said engagement; the tubular body of each of said first and second members comprising an axially extending outer tubular wall part and a co-axial core within said axially extending outer tubular wall part to form a cavity between the core and said outer tubular wall part which cavity is open at said first end of each of said respective first and second members; the core of one of said first and second members being tubular for its bore to open at said first end of its member, said bore axially receiving the core of the other of said first and second members when the first and second members are axially engaged; said first member having axially extending substantially straight and flat blade terminals within its tubular body and spaced circumferentially about its axis; said blade terminals extending from said second end of said first member body and terminating short of said first end thereof and each blade terminal presenting an axially extending contact edge and an axially extending support edge, the support edges of said blade terminals engaging substantially over their axial length with the body of said first member; said second member having spring terminals which extend axially within its tubular body from the second end of that body and terminate short of the first end thereof; said spring terminals being spaced circumferentially about the axis of said second member to correspond with the blade terminals when the two members are engaged; each spring terminal comprising a base part mounted on said body of said second member and a leaf terminal part which is cantilevered from and resiliently biased relative to the base part and presents a contact face that is inclined relative to the axis of said second member to converge towards the base part of its spring terminal as it approaches the end at which it is cantilevered and the first end of said second member; the terminals of said one of said first and second members being carried on that tubular core in the cavity of that one member and the terminals of the other of said first and second members being carried on the outer tubular wall part in the cavity of said other member; and wherein during engagement of said first and second members the outer tubular wall part of said other member is received axially within the outer tubular wall part of said one member and the core of said other member is received axially within the bore of the core of said one member and said engagement is initially without contact between the blade terminals and the spring terminals and subsequently the contact edges of the blade terminals engage and slide over the contact faces of the respective leaf terminal parts causing said leaf terminal parts to be displaced against their resilient biasing for substantial axial lengths of the contact edges of the blade terminals to abut in edge-to-face relationship the contact faces of the leaf terminal parts while the blade terminals are restrained from radial displacement relative to the axis of the second member by engagement of their support edges axially along the body of the first member.

2. An assembly as claimed in 1 in which the said one member is said second member and the base parts of the spring terminals are mounted on the tubular core so that their respective contact faces are directed outwardly of the axis of the second member and the contact faces are inclined relative to the axis of the second member to converge towards that axis as they approach the ends at which they are cantilevered and the first end of the second member while the blade terminals have their support edges engaging the outer tubular wall part of said first member so that their contact edges are directed radially inwardly of the first member.

3. An assembly as claimed in claim 1 in which the said one member is said first member and the blade members are mounted so that their support edges engage with the tubular core of the first member for their contact edges to be directed radially outwardly of the axis of that first member while the base parts of the spring terminals are mounted on the outer tubular wall part of said second member so that the contact faces of the spring terminals are directed inwardly of the second member and the contact faces are inclined relative to the axis of the second member to diverge from that axis as the contact faces approach the ends at which the leaf terminal parts are cantilevered and the first end of the second member.

4. An assembly as claimed in claim 1 in which said cavity formed between the axially extending core and outer tubular wall part of each of the first and second members further comprises an annular cavity.

5. An assembly as claimed in claim 1 in which the axially extending support and contact edges of each blade terminal are substantially straight and parallel with each other and with the axis of the first member.

6. An assembly as claimed in claim 1 in which each blade terminal is restrained from radial displacement relative to the first member at its end adjacent to the first end of that member by an angled nose part of the blade terminal co-operating with an undercut in the body of the first member.

7. An assembly as claimed in claim 1 in which each axially extending spring terminal has its base part doubled with the leaf terminal part and with the base part supported over an axial length thereof by the body of the second member.

8. An assembly as claimed in claim 1 in which free ends of the resiliently biased leaf terminal parts are of dog-leg profile to provide additional biasing and contact pressure when those dog-leg end profiles move into abutment with an adjacent surface in the second member following from their radial displacement by contact engagement of the spring leaf terminal parts with the terminal blades.

9. An assembly as claimed in claim 1 in which ends of the base parts of the spring terminals remote from the ends at which the leaf terminal parts are cantilevered are cranked to present terminal tail parts which project from the second end of the body of the second member.

10. An electrical connector assembly comprising first and second members which are engageable and disengageable co-axially with each other in a direction axially of those members for making or breaking respectively contact between terminals in the members; each of the members having an axially extending tubular body with axially opposed first and second ends which respectively lead and trail during said engagement; the tubular body of each of the members comprising an axially extending outer tubular wall part and a co-axial core within its outer tubular wall part to form a cavity between the core and the outer tubular wall part which cavity is open at the first end of the respective members; the core of one of said members being tubular and defining a bore to open at the first end of its member, said bore axially receiving the core of the other of said members when the first and second members are axially engaged; the tubular core of said one member carrying first terminal means which terminate short of the first end of said one member and are located in the cavity of that one member and the outer tubular wall part of said other member carrying second terminal means which terminate short of the first end of said other member and are located in the cavity of that other member, and wherein during engagement of the first and second members the outer tubular wall part of said other member is received axially within the outer tubular wall part of said one member and the core of said other member is received axially within the bore of the core of said one member and said engagement is initially without contact between the first and second terminal means and subsequently by electrical contact being effected as the first and second terminal means engage and slide axially over each other whereby said first terminal means of said one member and said second terminal means of said other member are "touchproof" when said one member and said other member are in engagement and when said one member and said other member are disengaged.

11. An assembly as claimed in claim 1 in which the blade terminals have their support edges located in firm engagement with axially extending slot means in the body of the first member.

12. An assembly as claimed in claim 11 in which the blade terminals are received in said slot means axially as a sliding fit by insertion of those terminals through the second end of the body of the first member during assembly of that member.

13. An assembly as claimed in claim 11 and comprising retaining means for retaining the blade terminals in engagement with the slot means within which they are respectively received.

14. An assembly as claimed in claim 13 in which the retaining means comprises recesses and projections which co-operate between the blade terminals on the body of the first member which recesses and projections snap engage during insertion of the blade terminals into the body of the first member.

15. An assembly as claimed in claim 1 in which the base parts of the spring terminals are received and supported in substantially complementary axially extending seat means in the body of the second member.

16. An assembly as claimed in claim 15 in which the base parts of the spring terminals are received in said seat means axially as a sliding fit by insertion of the spring terminals through the second end of the body of the second member during assembly of that member.

17. An assembly as claimed in claim 15 and comprising means for retaining the spring terminals with their base parts received in said seat means.

18. An assembly as claimed in claim 17 in which the retaining means for the spring terminals comprises plate means secured to the second end of the body of the second member for the spring terminals to be retained between said body and said plate means.

19. An assembly as claimed in claim 1 in which one of the first and second members includes a locking ring mounted on the body of that member for rotation about the axis thereof, said locking ring being profiled to provide part of a bayonet lock; the body of the other of the first and second members being profiled with another part of said bayonet lock which is complementary to that part in the locking ring whereby when the first and second members are fully engaged axially, the bayonet lock parts of the locking ring and said other member co-operate with each other and the locking ring is rotatable relative to the bodies of the two engaging members to actuate the bayonet lock and retain the two bodies from being dis-engaged axially.

20. An assembly as claimed in claim 19 in which the locking ring is mounted on the body of said one member for rotation in a radial plane of that one member.

21. An assembly as claimed in claim 19 and comprising co-operating projections and recesses provided between the locking ring and the body of either of said two members so that as the locking ring is rotated and approaches at least one of a locked or unlocked condition increased torque has to be applied to the locking ring to overcome resistance presented by the co-operating recesses and projections to effect a final locked or unlocked condition of the locking ring.

22. An assembly as claimed in claim 21 in which said projections and recesses are provided between the locking ring and the body of the member on which the ring is mounted.

23. An assembly as claimed in claim 19 in which the locking ring is provided on the body of said first member.

24. An assembly as claimed in claim 20 in which the locking ring is rotatably mounted on the body of said one member as a snap engaging fit on that body.

25. An assembly as claimed in claim 24 in which the body of said one member is provided with a radially outwardly directed flange having an outer peripheral edge of substantially saw tooth profile in axial section and said locking ring has a radially inwardly extending flange with an inner peripheral edge of substantially saw tooth profile in axial section of the locking ring, said saw tooth profile edge of the locking ring snap engaging with the saw tooth profile edge on the body of said one member as the locking ring is displaced axially over the body of said one member in a direction from the first end to the second end of that body to retain the locking ring axially on that body.

26. An assembly as claimed in claim 1 in which the blade terminals have terminal heads which are presented at the second end of the body of the first member for connection to electrical cable.

27. An assembly as claimed in claim 26 in which the terminal heads are enclosed within a housing attached to the body of the first member and through which housing cable is to extend for connection to the terminal heads.

28. An assembly as claimed in claim 27 in which the housing comprises axially extending shells which are assembled and secured together about the body of the first member with radially extending recesses and flanges cooperating between the shells and said body to retain the housing on the body of said first member when the shells are secured together.

* * * * *